US007409726B2

(12) United States Patent
Bahm et al.

(10) Patent No.: US 7,409,726 B2
(45) Date of Patent: Aug. 12, 2008

(54) METHODS FOR SECURING BIBS TO GARMENTS AND RELATED CLOTHING ARTICLES

(76) Inventors: Angela B. Bahm, 918 6th Ave. S., Edmonds, WA (US) 98020; Linda L. Baker, 18905 Olympic View Dr., Edmonds, WA (US) 98020; R. Alan Burnett, 4108 131st Ave. SE., Bellevue, WA (US) 98006

( * ) Notice: Subject to any disclaimer, the term of this patent is extended or adjusted under 35 U.S.C. 154(b) by 137 days.

(21) Appl. No.: 11/356,883

(22) Filed: Feb. 17, 2006

(65) Prior Publication Data

US 2007/0192924 A1 Aug. 23, 2007

(51) Int. Cl.
*A41B 13/10* (2006.01)
*A41B 13/00* (2006.01)
*A41D 11/00* (2006.01)

(52) U.S. Cl. ..... 2/49.1; 2/80; 2/111

(58) Field of Classification Search ..... 2/48, 2/49.1–49.5, 52, 51, 50, 46, 80, 119, 120, 2/83, 95, 106, 116, 103, 75; D2/860–864, D2/733, 776, 745, 841, 842, 718–720
See application file for complete search history.

(56) References Cited

U.S. PATENT DOCUMENTS 134,909 A * 1/1873 Marr ..... 2/119
343,006 A * 6/1886 Butz ..... 2/115
652,164 A * 6/1900 Butz ..... 2/119
860,257 A * 7/1907 Slater ..... 2/49.2
1,128,168 A * 2/1915 Marcus ..... 2/103
1,503,983 A * 8/1924 Clements ..... 2/120
1,647,385 A * 11/1927 Voorsanger ..... 2/48
1,808,496 A * 6/1931 Dillon ..... 2/111
2,212,719 A * 8/1940 Prouty ..... 2/93
2,425,635 A * 8/1947 Nitzberg ..... 2/75
2,556,039 A * 6/1951 Landert ..... 2/106
2,688,136 A * 6/1954 Freedman ..... 2/105
2,712,650 A * 7/1955 Harrington ..... 2/119
2,747,194 A * 5/1956 Ranieri ..... 2/119

(Continued)

OTHER PUBLICATIONS

YKK Fastening Products Group Online Catalogue; http://www.ykkfastening.com/global/products/sb/item.html (Date Unknown).

(Continued)

*Primary Examiner*—Amy B Vanatta
(74) *Attorney, Agent, or Firm*—Law Office of R. Alan Burnett

(57) ABSTRACT

Methods for securing bibs to garments and related articles of clothing. Various schemes are disclosed for securing a bib to a mating garment using one or more points of attachment employing a respective mating pair of fastener halves at each point of attachment. The schemes include employment of a mating pair of fastener to secure the bib to a shoulder of a garment. Meanwhile, in some embodiments a mating pair of fastener is used to secure the lower portion of the bib to a chest area of the garment. Under other embodiments, a three-point attachment scheme is employed including using a pairs of fasteners to secure the straps of a bib to the shoulders of the garment and another mating pair of fasteners to secure the lower portion of the bib to the garment.

18 Claims, 19 Drawing Sheets

U.S. PATENT DOCUMENTS

| | | | | |
|---|---|---|---|---|
| 2,879,514 | A * | 3/1959 | Shapiro | 2/48 |
| 2,922,164 | A * | 1/1960 | Liff | 2/49.2 |
| 4,569,086 | A * | 2/1986 | Takefman | 2/49.2 |
| 4,754,500 | A * | 7/1988 | Brucato et al. | 2/105 |
| 5,778,450 | A * | 7/1998 | Hagestad et al. | 2/49.3 |
| 5,911,311 | A * | 6/1999 | Hutchins | 2/49.5 |
| 6,032,287 | A * | 3/2000 | Kallas | 2/69 |
| D438,365 | S * | 3/2001 | Mattrasingh | D2/841 |
| 6,216,269 | B1 * | 4/2001 | Smith et al. | 2/46 |
| 6,374,411 | B1 | 4/2002 | Duhn | |
| 6,408,439 | B1 * | 6/2002 | Garforth-Crippen | 2/80 |
| 7,032,247 | B2 * | 4/2006 | Frieswick et al. | 2/49.1 |
| 2006/0026728 | A1 * | 2/2006 | Shaw | 2/49.1 |
| 2007/0250979 | A1 * | 11/2007 | Han | 2/49.1 |

OTHER PUBLICATIONS

Snap it Up, Home Sewing Association Guidelines; 2001; http://www.snapsource.com/faqs/introtosnaps.php.

Selecting Snaps, Home Sewing Association Guidelines; 2005; http://www.sewing.org/files/guidelines/6_155_selecting_snaps.pdf.

* cited by examiner

METHODS FOR SECURING BIBS TO GARMENTS AND RELATED CLOTHING ARTICLES

CROSS REFERENCE TO RELATED APPLICATIONS

The present application includes common subject matter to concurrently-filed application Ser. No. 11/356,882 entitled METHODS FOR SECURING BIBS TO GARMENTS AND RELATED CLOTHING ARTICLES,

FIELD OF THE INVENTION

The field of invention relates generally to bibs for babies and toddlers, and, more specifically but not exclusively relates to clothing articles that provide means for keeping a child's bib secured neatly to their clothing.

BACKGROUND INFORMATION

It is conventional practice for children to wear bibs frequently when they are infants and toddlers. Bibs are used during feedings to protect clothing and also throughout the day to keep clothing free from spit up and drool. When a bib gets soiled, it can simply be replaced, saving the effort of having to change the baby's clothing. This is particularly advantageous in the child care industry, but also appreciated by caretakers in general.

Due to a child's movement, bibs have a tendency to twist and turn around the neck. If the front of the bib is over the child's shoulder or has turned around to the child's back, it is no longer functional. This creates the need for frequently having to reposition a bib. Bibs also have a tendency to cover a child's face when a child lies on his or her back to play or sleep. Moreover, an infant's involuntary arm movement will often cause the bib to cover the infant's face. This is problematic, primarily because of the risk of SIDS, and secondly because of the child's general frustration with having fabric covering his or her face. Accordingly, it would be advantageous to provide a means for keeping a bib secured to a child's clothing.

SUMMARY OF THE INVENTION

In accordance with aspects of the present invention, techniques are disclosed for effectively securing a bib to a garment worn by a baby or toddler. Various schemes are disclosed for securing a bib to a mating garment using one or more points of attachment employing a respective mating pair of fastener halves at each point of attachment. The schemes include employment of a mating pair of fasteners to secure the bib to a shoulder of a garment. Meanwhile, in some embodiments a mating pair of fasteners are used to secure the lower portion of the bib to a chest area of the garment. Under other embodiments, a three-point attachment scheme is employed including using a pair of fasteners to secure the straps of a bib to the shoulders of the garment and another mating pair of fasteners to secure the lower portion of the bib to the garment.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein like reference numerals refer to like parts throughout the various views unless otherwise specified.

DETAILED DESCRIPTION

Embodiments of methods for securing bibs to garments are associated articles of clothing are described herein. In the following description, numerous specific details are set forth to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As described herein, various mating fasteners are employed to secure bibs to garments at various attachment points. These mating fasteners include, but are not limited to various types of snap fasteners, button fasteners, and hook-and-loop fasteners. For general reference, each component in a pair of mating fasteners comprises a fastener "half", identifying that the fastener mates with a corresponding fastener half in a manner that secures the two fastener components together. For example, mating female and male snap fasteners mate together, a button mates with a corresponding button hole, and a portion of "hook" fabric is mated to a portion of "loop" fabric to form a hook-and-loop fastener. In each instance, the mating components comprise fastener halves.

Figure 1A:
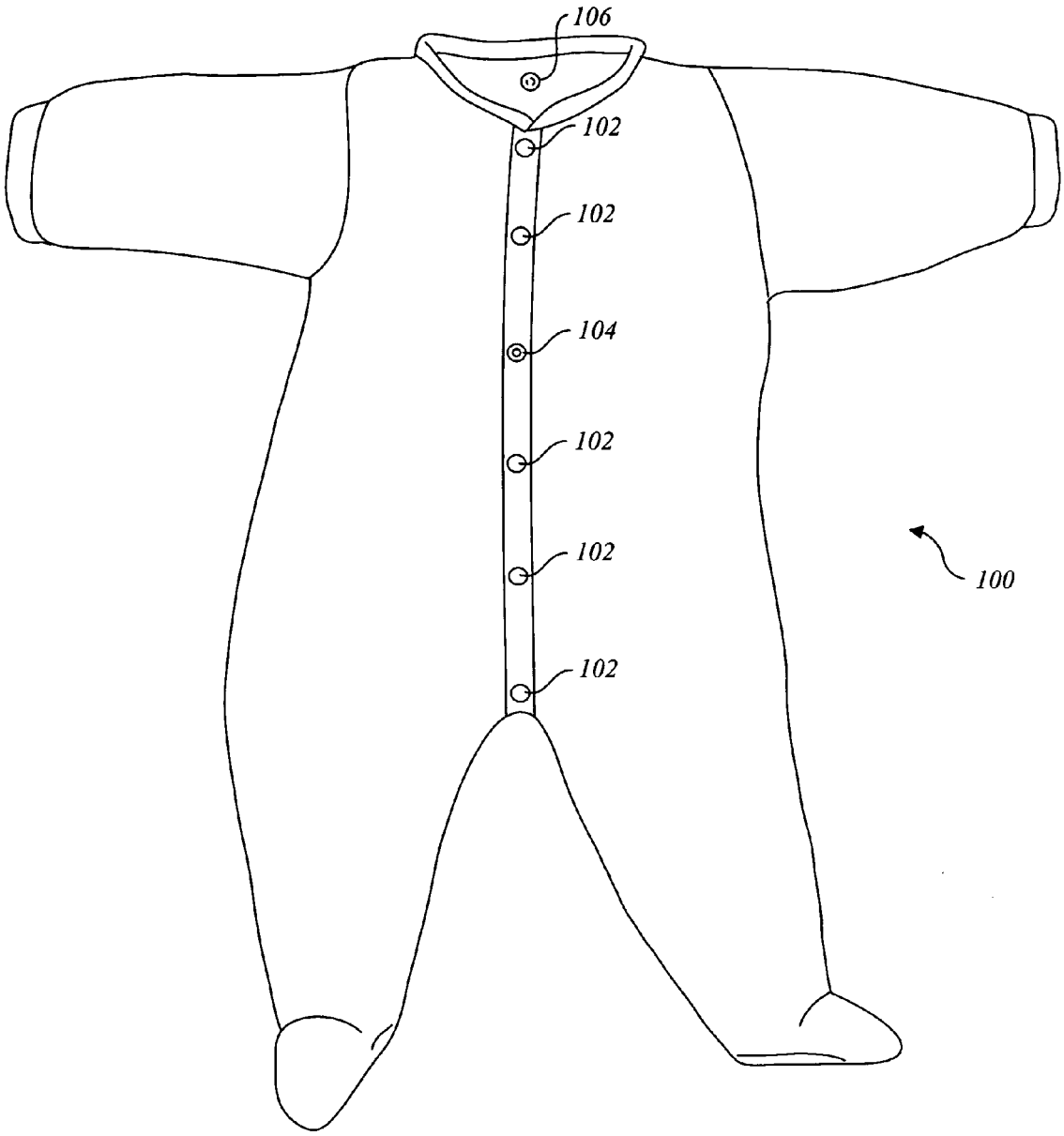
FIG. 1*a* shows a exemplary baby garment known as a sleeper with snap fasteners used to secure the garment, including a pair of snap fasteners with socket faces that are used to secure a bib to the garment.

An exemplary baby garment 100 in accordance with one embodiment of the invention is shown in FIG. 1. Baby garment 100 is generally illustrative of various types of baby garments that are well known in the clothing industry. For example, baby garment 100 depicts a common type of "sleeper" that includes built-in footings, such that there is no need for a baby to wear socks or other footwear to keep the baby's feet warm. In a typical configuration, such as illustrated in FIG. 1, this type of garment will include a set of snap fasteners used to secure the garment together across the frontal area. For baby garment 100, a plurality of snap fasteners 102 run generally from the crotch to the neck area. The use of snap fasteners allows a parent or caregiver to quickly split the upper half of baby garment 100 to easily remove the garment (e.g., for changing the baby), and the snaps provide a convenient way to quickly couple the left- and right-hand front portions of the garment together in a secure manner. In an optional configuration, many sleepers use a zipper in place of the snap fasteners to provide similar functionality.

As discussed above, one aspect of the invention is to provide a means for securing the lower portion of a bib to a mating garment worn by babies, toddlers, and the like. In the embodiment illustrated by baby garment 100, a three-part snap fastener assembly including a two-way socket 104 is employed. As described in further detail below with reference to FIG. 6, this three-part snap fastener assemble provides conventional functionality with respect to fastening the left- and right-hand front portions of a garment together, while additionally enabling the lower portion of a bib to be secured to the garment using a "second" pair of mating snap fasteners. The net result yields a "stacked" snap fastener configuration.

Figure 7:
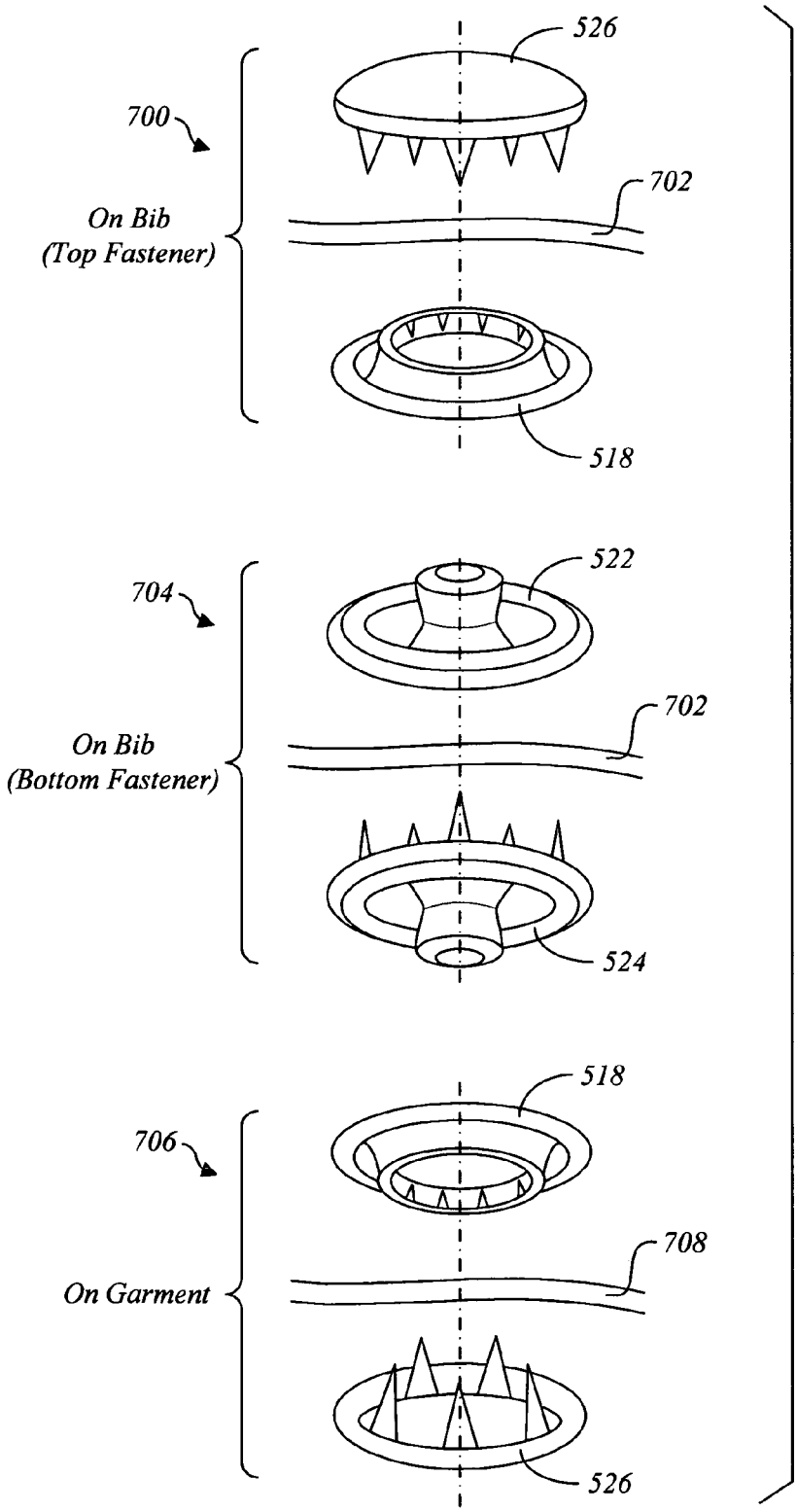
FIG. 7 shows an exploded view of another three riveted part stacked snap fastener assembly used in the embodiment of FIGS. 1*a*, 1*b*, and 8 to secure the neck portion of the bib of FIGS. 2 and 8 to the baby garment.

In accordance with another aspect of some embodiments, a means is provided to secure the upper portion (i.e., the portion that goes around the neck) of a bib to the back of the garment proximate to the neck. Again, a type of three-part snap fastener assembly is used in one embodiment. As described in further detail below with reference to FIG. 7, this three-part snap fastener assemble provides conventional functionality with respect to fastening the left- and right-hand neck portions of a bib together, while additionally securing the neck portion of the bib to the back of baby garment 100 using a socket 106 that is employed as half of a "second" pair of mating snap fasteners.

Figure 1B:
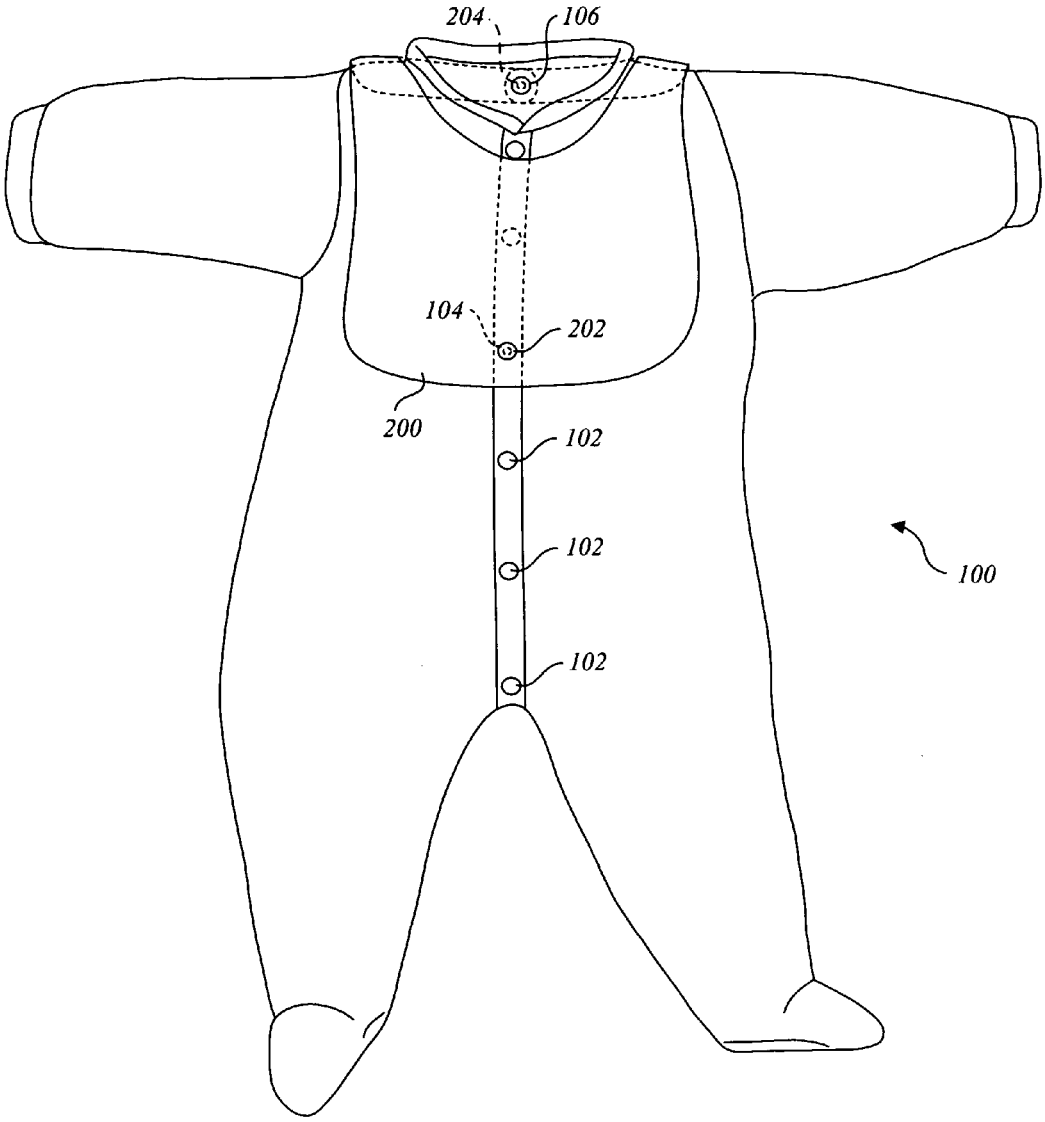
FIG. 1*b* shows the baby garment of FIG. 1*a* with the bib of FIG. 2 secured to the garment.
Figure 2:
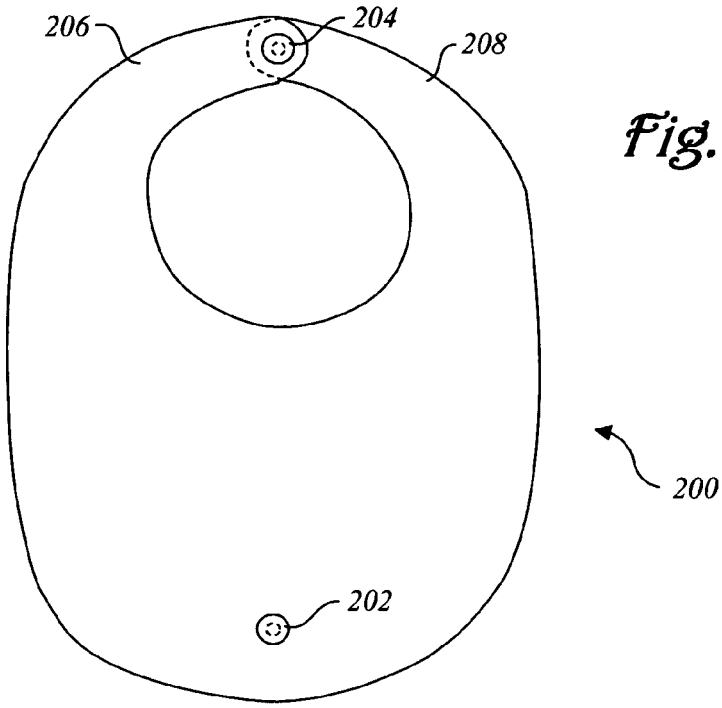
FIG. 2 shows an exemplary bib configured to mate with the baby garment of FIGS. 1*a* and 1*b* using a pair of snap fasteners.

Aspects of an exemplary bib 200 used to mate with baby garment 100 are shown in FIG. 2. In general, the overall shape of bib 100 is illustrative of various conventional bib shapes, including bibs that have a rounded lower portion (as shown in FIG. 2) and bibs with a more rectangular shape (as shown in FIG. 1*b*). From a functional standpoint (with respect to aspects of the present invention), the overall shape of the bib is unimportant.

One inventive aspect of bib 200 is the inclusion of a male snap fastener 202 (i.e., a snap fastener half with a stud extending underneath) disposed toward the lower frontal portion of the bib so as to mate with the top socket for two-way socket 104. In implementations that further include a neck securing means, one embodiment of a bib will also include a two-part snap fastener assembly 204, further details of which are discussed below with reference to FIG. 7. The two-part snap fastener is used, in part, to secure the left neck strap 206 over a portion of the right neck strap 208. Of course, an alternative configuration may have the right neck strap overlapping the left neck strap.

FIG. 1*b* depicts bib 200 secured to baby garment 100 by means of the aforementioned three-part snap fasteners. More specifically, male snap fastener 202 is snapped into the top socket of two-way socket 104 to secure the lower frontal portion of bib 200 to garment 100. Meanwhile, a stud extending from the bottom of two-part fastener 204 is secured within socket 106 of baby garment 100 to secure the neck portion of bib 200 to the garment.

Figure 4:
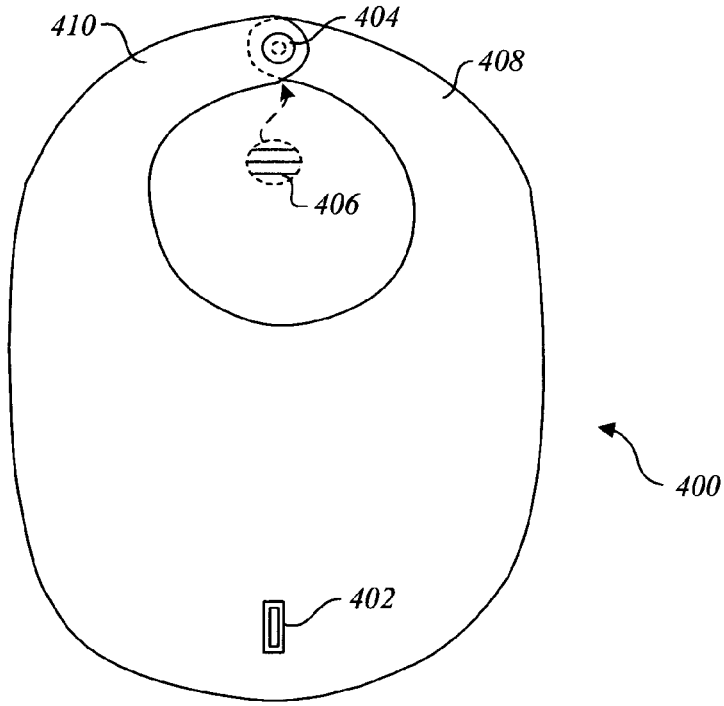
FIG. 4 shows an exemplary bib configured to mate with the baby garment of FIGS. 3*a* and 3*b* using a button and a mating half of a hook-and-loop fastener.
Figure 3A:
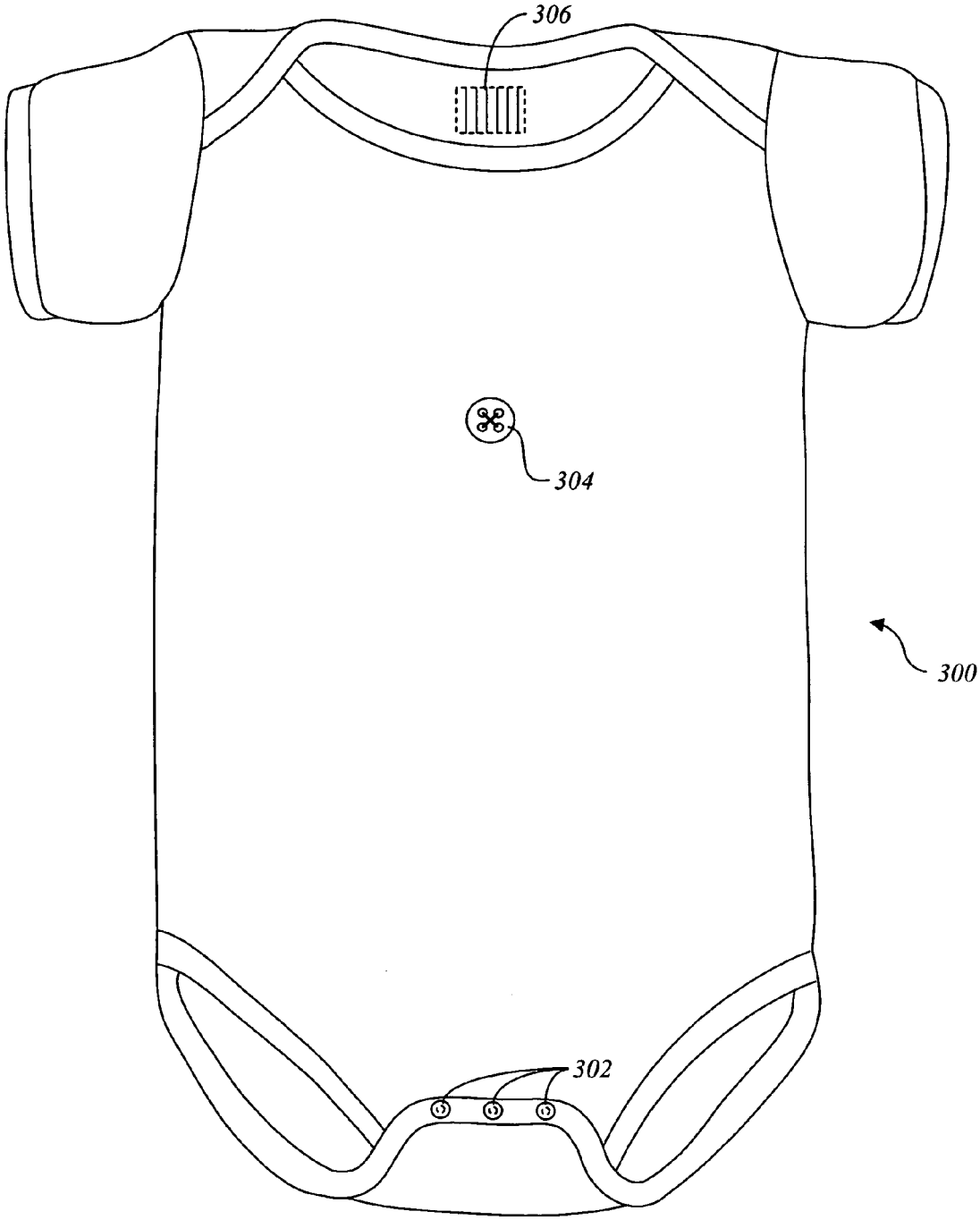
FIG. 3*a* shows a baby or toddler garment known as a "onesie" that includes a button and a half of a hook-and-loop fastener that are employed to secure the bib of FIG. 4.
Figure 3B:
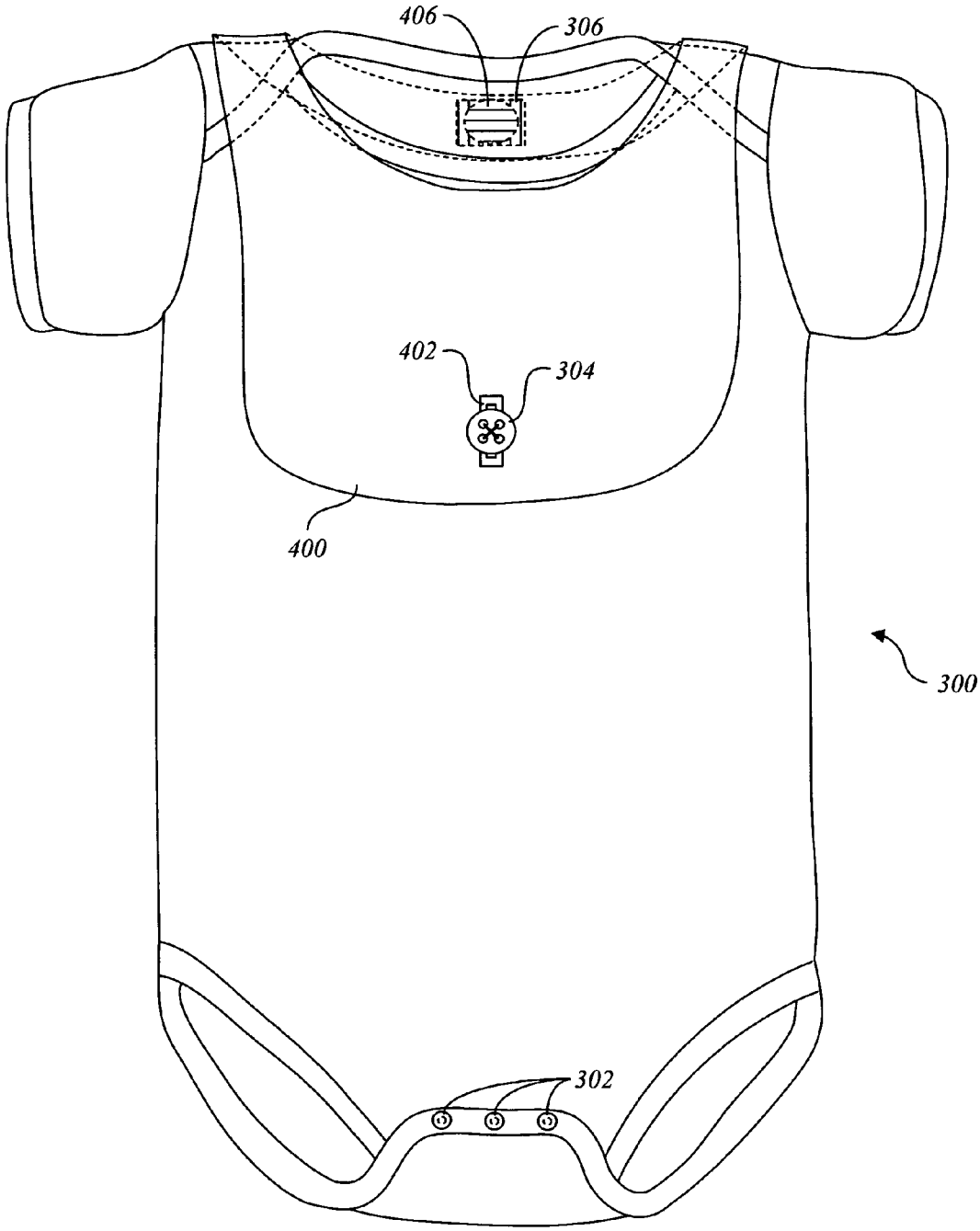
FIG. 3*b* shows the garment of FIG. 3*a* with the bib of FIG. 4 secured to the garment.

Another technique for securing a bib to a baby garment is illustrated in FIGS. 3*a*, 3*b*, and 4. A baby garment 300 comprising a baby or toddler "onesie" is shown in FIGS. 3*a* and 3*b*. As is common with this type of garment, a flap extending from the back of the garment is folded over the front of the garment in the crotch area and secured by fasteners 302, which typically comprise snap fasteners. In addition to this conventional configuration, baby garment 300 includes a button 304 secured to the upper chest area of the garment. As shown in FIGS. 3*b* and 4, baby article 300 is designed to mate with a bib 400 that includes a button hole 402 into which button 304 is inserted upon assembly to secure the lower portion of bib 400.

Figure 3C:
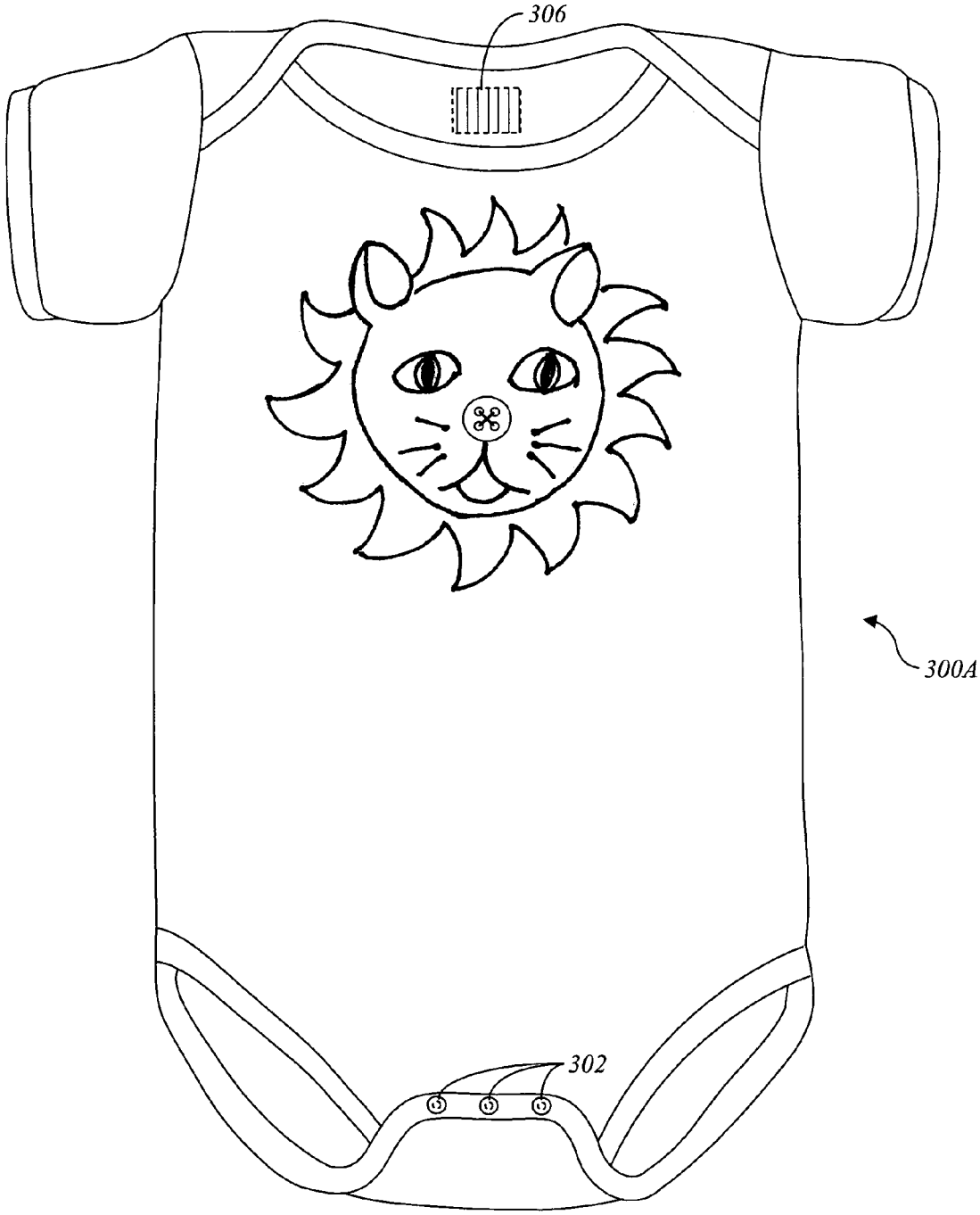
FIG. 3*c* shows a variation of the garment of FIG. 3*a*, wherein the button is used for the nose of a lion appliqué on the front garment.

As shown in FIG. 3*c*, one or more of the fastener in the embodiments herein may be employed as part of a design on the front of a garment. In the illustrated example, a lion appliqué that employs button 304 for the lion's nose is disposed on the front of a garment 300A. Similarly, a button may be used as a nose or another feature for various types of animals, as well as other types of designs. Moreover, snaps may be incorporated into the features of an appliqué or silk-screened design in a similar manner. This enables a fastener or fasteners to appear as if they are an integral part of a garment's design, rather than an added component. Thus, garment aesthetics are maintained or enhanced, while providing the added functionally of providing a means for securing a bib to the garment.

FIGS. 3*a*, 3*b*, and 4 also depict another way for securing the neck portion of a bib to the back neck area of a baby garment. In this instance, hook-and-loop fasteners generally referred to as "Velcro" fasteners are employed. (It is noted that although Velcro® is a registered trademark, it is common practice to refer to hook-and-loop fasteners of similar type as "Velcro" fasteners regardless of their manufacturer; accordingly, the use of the term "Velcro" herein refers to hook-and-loop fasteners in the generic sense.) In further detail, a first piece of Velcro 306 is attached to the back of baby garment 300 in the neck area, as shown in FIGS. 3*a* and 3*b*. Typically, Velcro 306 may be sewed on or secured using an appropriate adhesive. Meanwhile, a mating piece of Velcro 406 is attached to the backside of neck strap 408 of bib 400, which is disposed behind neck strap 410 upon assembly of the bib around a baby's neck. Upon attachment to baby garment 300, the Velcro pieces 306 and 406 are placed proximate to one another and secured with a person's fingers in the normal manner for attaching mating portions of Velcro together. It will be understood that which of pieces 306 and 406 includes the hooks and which piece includes the loops is not important, but rather that one of the Velcro pieces 306 and 406 includes the hooks, while the other piece includes the loops to which the hooks engage to secure the pieces together.

In FIG. 4, the neck straps 408 and 410 are depicted as being secured using a fastener set 404. However, this is merely illustrative of one way to secure the neck straps together. In another embodiment, the neck straps are secured using mating hook-and-loop fasteners.

It is further noted that the particular fastener usages depicted herein are also illustrative, but not limited. In general, any type of fastener technique may be combined to yield the desired results. For example, baby garment 100 may be configured to employ hook-and-loop fasteners for either securing the neck area, the lower frontal portion, or for both. Similarly, a stacked fastener scheme may be employed to secure bib 400 to the neck area of baby garment 300, while a hook-and-loop scheme may be used to secure the neck portion of bib 100 to baby garment 100.

There are various types of snap fasteners that may employed for the snap fasteners disclosed herein. In general, snap fasteners are considered as a part of fasteners that are configured to mate with one another using a small amount of force, wherein the engagement of the mating parts creates a "snap" sound. Snap fasteners comprise four-part buttons riveted on to two portions of fabric or material meant to be held together. Meanwhile, it is also conventional usage to refer to snap fasteners as two-part fasteners, with one engaging the other upon assembly.

Figure 5A:
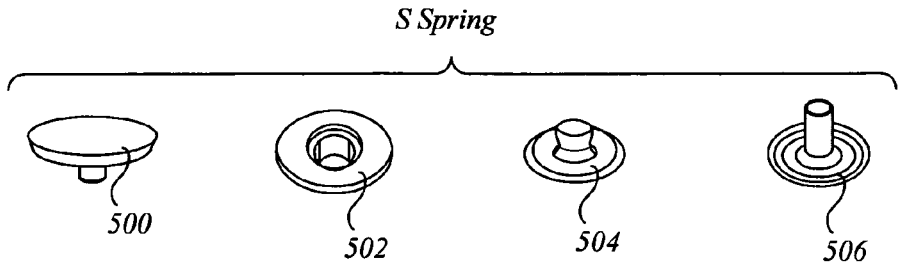
FIG. 5*a* shows an exemplary set of S Spring snap fastener parts.

Under the four-part terminology, snap fasteners include a top, a socket, a stud, and a post. In addition, there are generally three types of snap fasteners: S-Spring snap, Ring Spring snap, and Ring Prong snap. Exemplary sets of parts for S-Spring, Ring Spring, and Ring Prong snaps are respectively illustrated in FIGS. 5*a*, 5*b*, and 5*c*. For example, FIG. 5*a* depicts a top 500, a socket 502, a stud 504, and a post 506. During a riveting operation, the top 500 and socket 502 are disposed on opposite sites of a first piece of fabric or material and pressed together using an appropriate tool to for the first half of a fastener pair. Meanwhile, to form the second half of the fastener pair, the post 506 is inserted through the fabric/material into stud 504 using an appropriate tool, such that the respective flanges for stud 504 and post 506 are disposed on opposite sides of the fabric/material, thereby forming a rivet.

Figure 5B:
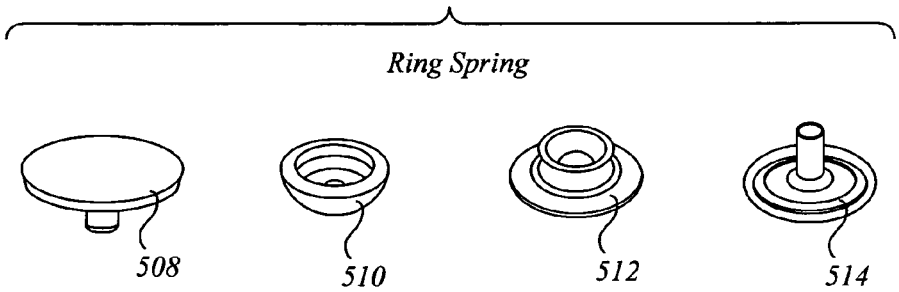
FIG. 5*b* shows an exemplary set of Ring Spring snap fastener parts.

An exemplary set of Ring Spring snap parts including a top 508, a socket 510, a stud 512, and a post 514 are depicted in FIG. 5*b*. As before, the top 508 is mated with socket 510 to form the first riveted fastener half, while the post 514 is inserted into stud 512 to form the second riveted fastener half.

Figure 5C:
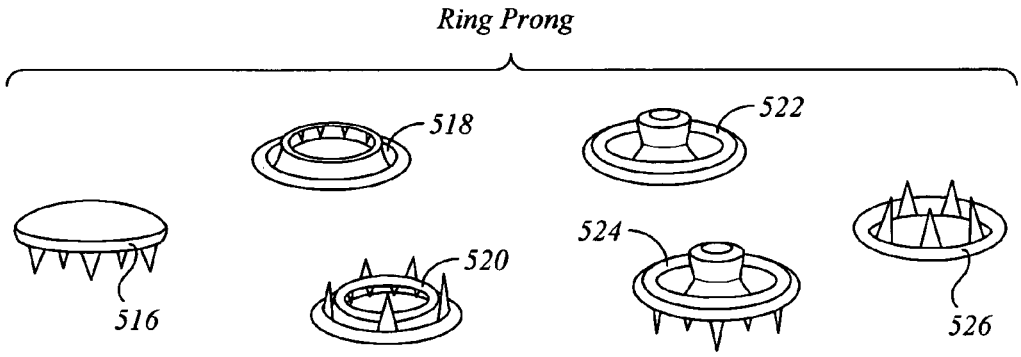
FIG. 5*c* shows an exemplary set of Ring Prong snap fastener parts.

Ring Prong snaps use various types of prongs to facilitate the riveting functional. For example, exemplary Ring Prong snap components are shown in FIG. 5*c*. These include a capped prong ring 516 (which functions as a top), a socket 518 and a pronged socket 520, a stud 522 and a pronged stud 524, and an open pronged ring 526 which performs the post function described above. As before, an appropriate tool is used to form the riveted fastener halves. An open pronged ring may also me used in place of a capped prong ring for the top.

Figure 6:
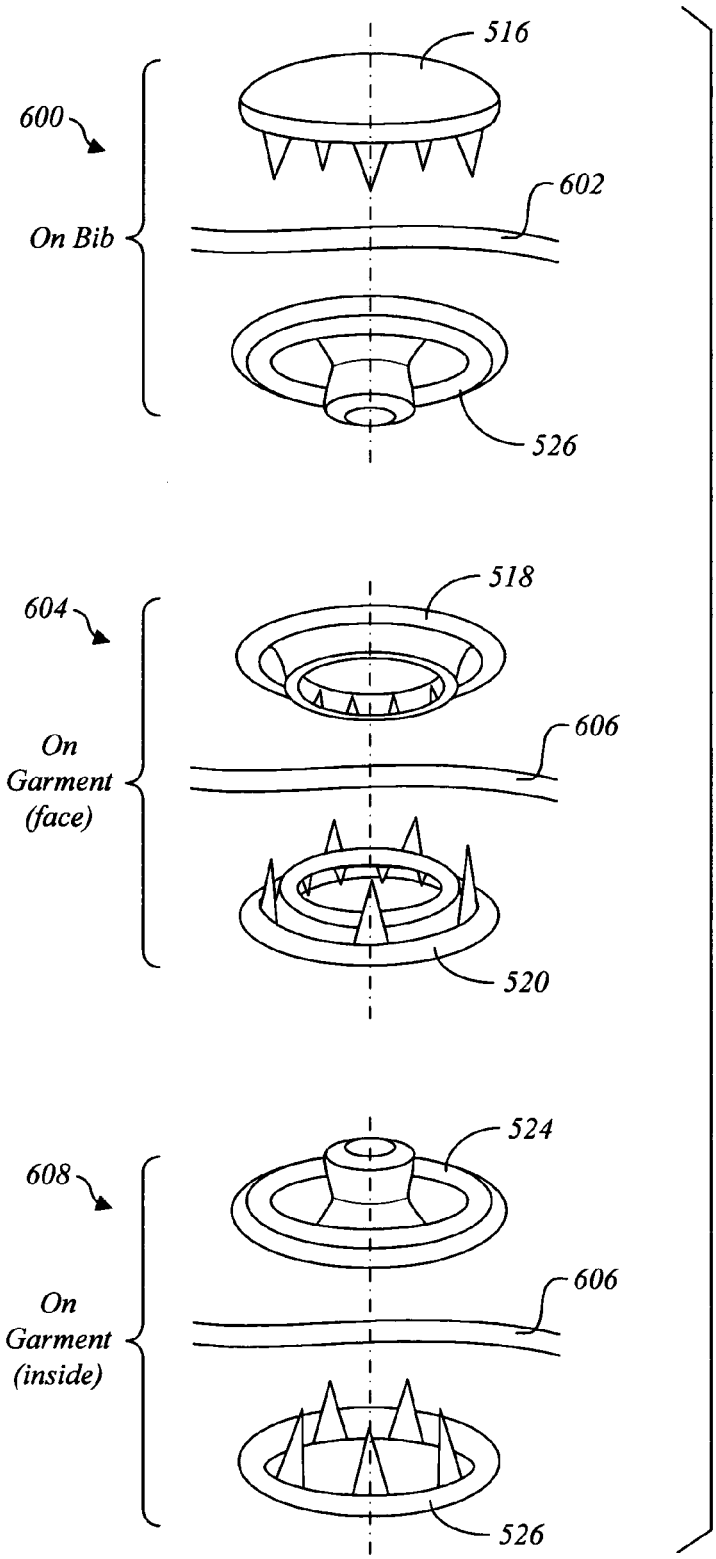
FIG. 6 shows an exploded view of a three riveted part stacked snap fastener assembly used in the embodiment of FIGS. 1*a*, 1*b*, and 8 to secure the lower portion of the bib of FIGS. 2 and 8 to the baby garment.

A first exemplary three- (riveted) part stacked fastener assembly employing six Ring Prong Snap parts is shown in FIG. 6. A first snap part 600 is formed on the bib by riveting a capped prong ring 516 to a stud 524, which are disposed on opposite sides of bib fabric 602. A second snap part 604 is formed on the face of the garment by riveting a socket 518 to a pronged socket 520, which are disposed on opposite sides of garment fabric 606. Meanwhile, a third snap part 608 is formed on the inside of the garment (inside in consideration of the coupled configuration) by riveting an open pronged ring 526 to a stud 524 disposed on opposing sides of garment fabric 606. As is well-known, an appropriate interfacing material (not shown) may be used to reinforce the area of fabric proximate to the riveted fasteners, if desired.

A second exemplary three- (riveted) part stacked fastener assembly employing six Ring Prong snap fastener parts is shown in FIG. 6. A first snap part 700 comprising a top fastener is formed on a bib by riveting an open prong ring 526 to a socket 518, which are disposed on opposite sides of bib fabric 702. A second snap part 704 comprising a bottom fastener is formed on the bib by riveting a stud 522 to a pronged stud 524, which are disposed on opposite sides of bib fabric 702. Meanwhile, a third snap part 706 is formed on the topside of the garment by riveting an open pronged ring 526 to a socket 518 disposed on opposing sides of garment fabric 708. Again, an appropriate interfacing material may be used to reinforce the area of fabric proximate to the riveted fasteners.

In accordance with some embodiments, the mating fastening means on the bib and mating garment are positioned so as to provide a matched set. Furthermore, in some embodiments the bib and garment sets are sized, wherein a bib of size X is designed to mate with a garment of the same size X. Moreover, the bibs and garments for given sizes are envisioned to be sold individually as well as in sets, enabling buyers to mix and match bibs and garments.

Figure 8:
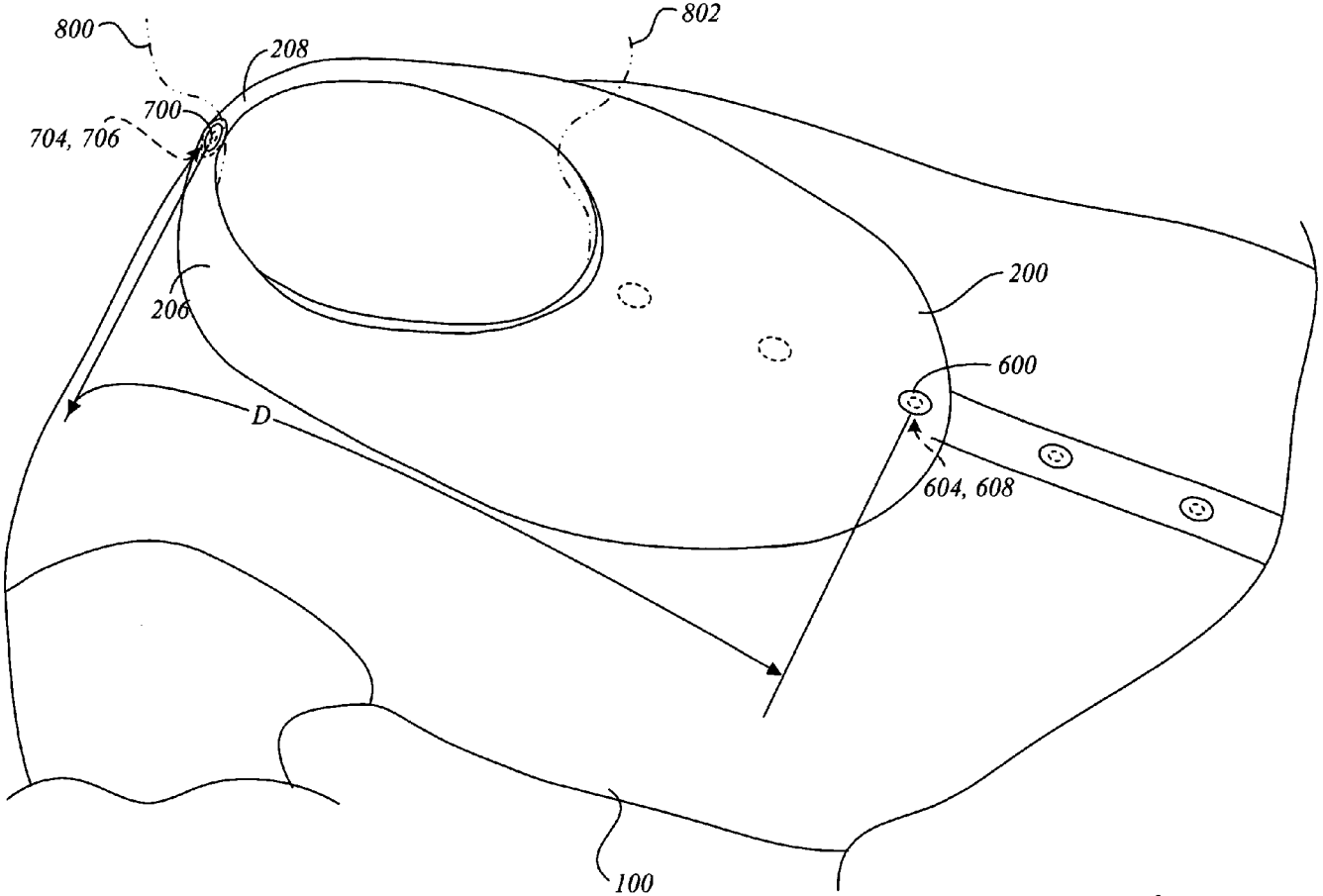
FIG. 8 is a schematic drawing illustrating how the positioning of the fasteners on a bib and matching garment are configured.

FIG. 8 shows an exemplary matched bib-garment set, according to one embodiment. FIG. 8 shows baby garment 100 being worn by a baby, whose neck outline is shown in phantom lines 800 and 802. To secure bib 200 to baby garment 100 the following operations may be employed. First, a bottom fastener 704 on right neck strap 208 will be secured to a mating snap fastener 706 riveted to the back neck area of baby garment 100. A top fastener 700 riveted to the left neck strap 206 is then secured to bottom bib fastener 704 to secure the upper portion of bib 200 around the baby's neck. The front portion of bib 200 is then secured by snapping a fastener 600 riveted to the lower portion of bib 200 to a garment face fastener 604 that is riveted to an overlapping face of baby garment 100. Meanwhile, garment face fastener 604 is snapped into a mating snap fastener 608 riveted to the baby garment under the overlap.

As further illustrated in FIG. 8, the distance D between the mating fastener parts on bib 200 and baby garment 100 are set so that the front of the bib lies substantially flat against the garment when secured. Rather than require the distances between the fastener pairs be equal when the garment is not being worn, FIG. 8 is attempting to show how the distance should be determined when a baby garment is being worn. As such, distance D will not be a straight line, but will generally be somewhat arcuate. In addition, in some embodiments the distance D may vary with different sizes of garments, such that larger bibs are configured to mate with larger-size garments.

Figure 9:
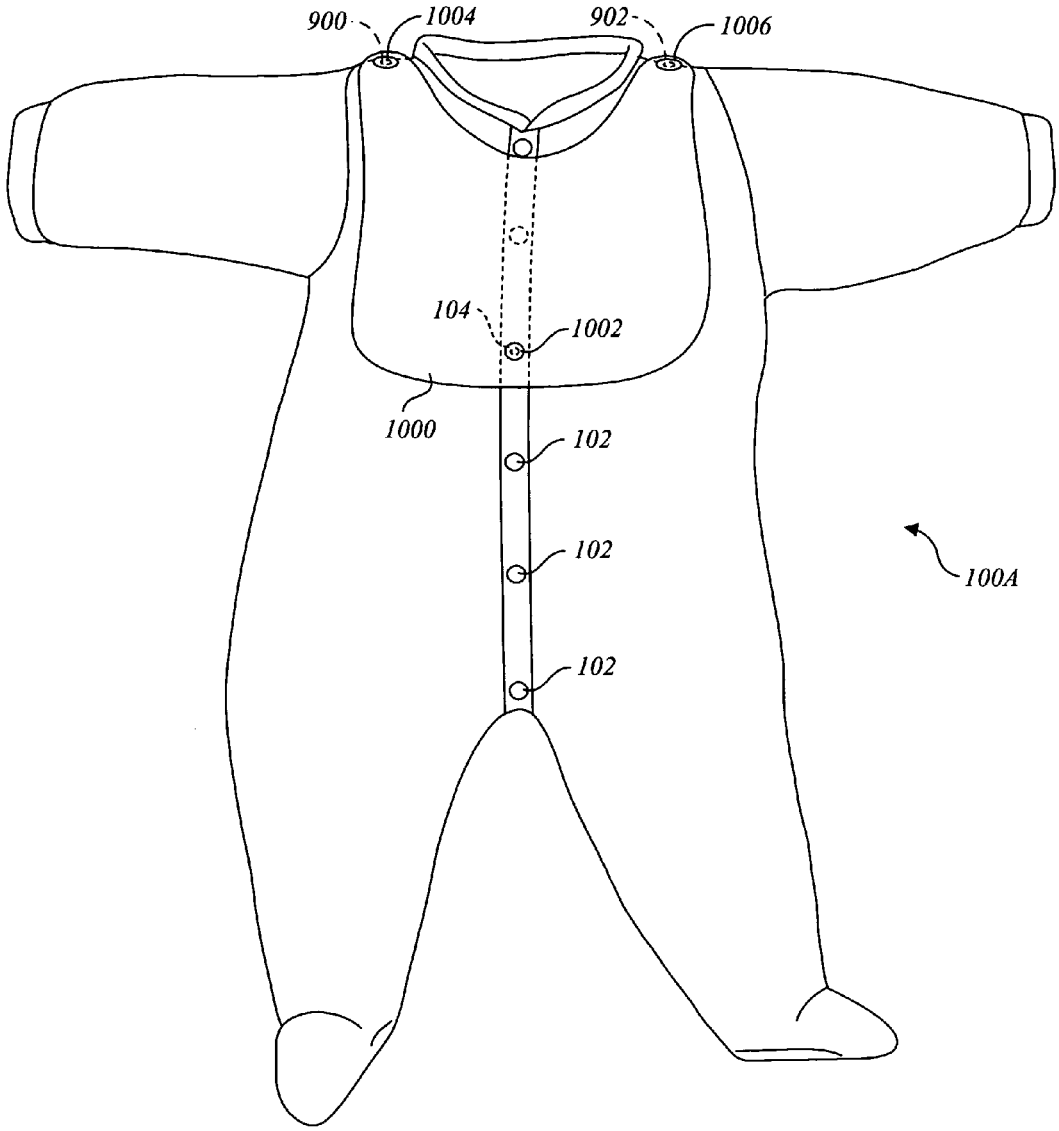
FIG. 9 shows an alternate configuration of the baby garment of FIGS. 1*a* and 1*b* including a pair of snap fasteners disposed on the shoulders of the garment and a mating bib of FIG. 10, wherein the bib is secured to the garment via the pair of snap fasteners on the shoulders and a snap fastener in the front.
Figure 10:
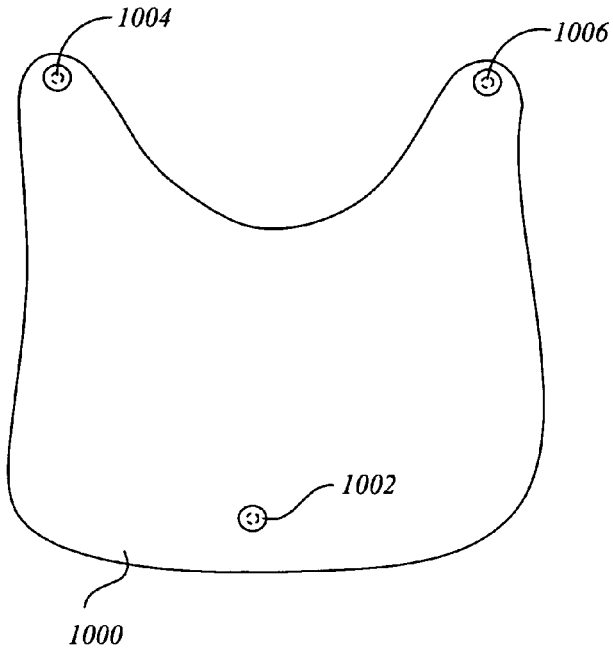
FIG. 10 shows a bib that mates with the baby garment of FIG. 9.

According to yet further aspects of the invention, garment and bib clothing sets are provided that employ a pair of fasteners on the shoulders of the garment and a fastener in the front of the garment to secure the bib to the garment by means of a three-point attachment scheme. Exemplary garments and mating bibs illustrative of this technique are shown in FIGS. 9-12. For example, FIG. 9 shows a baby garment 100A depicting an alternative configuration of baby garment 100 discussed above, wherein a pair of snap fastener sockets 900 and 902 are disposed on the respective shoulders of the garment. As before, baby garment 100A includes a two-way socket 104 including a snap fastener socket disposed on the outer face of the garment. Meanwhile, the mating bib 1000, as shown in FIG. 10, includes three snap fasteners 1002 (disposed on the lower portion), 1004, and 1006 (disposed toward the ends of respective left and right shoulder straps) having studs extending underneath that are located to match the location of the mating snap fastener halves (i.e., two-way socket 104 and snap fastener sockets 900 and 902) on baby garment 100A.

Figure 12:
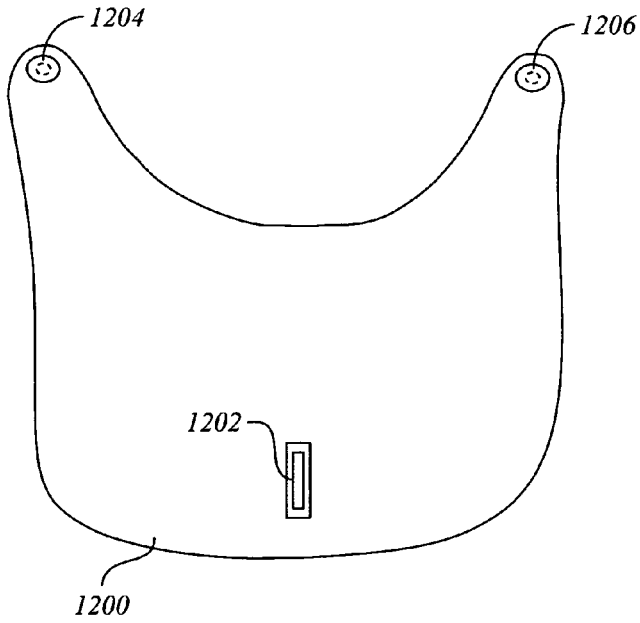
FIG. 12 shows a bib that mates with the baby garment of FIG. 11.
Figure 11:
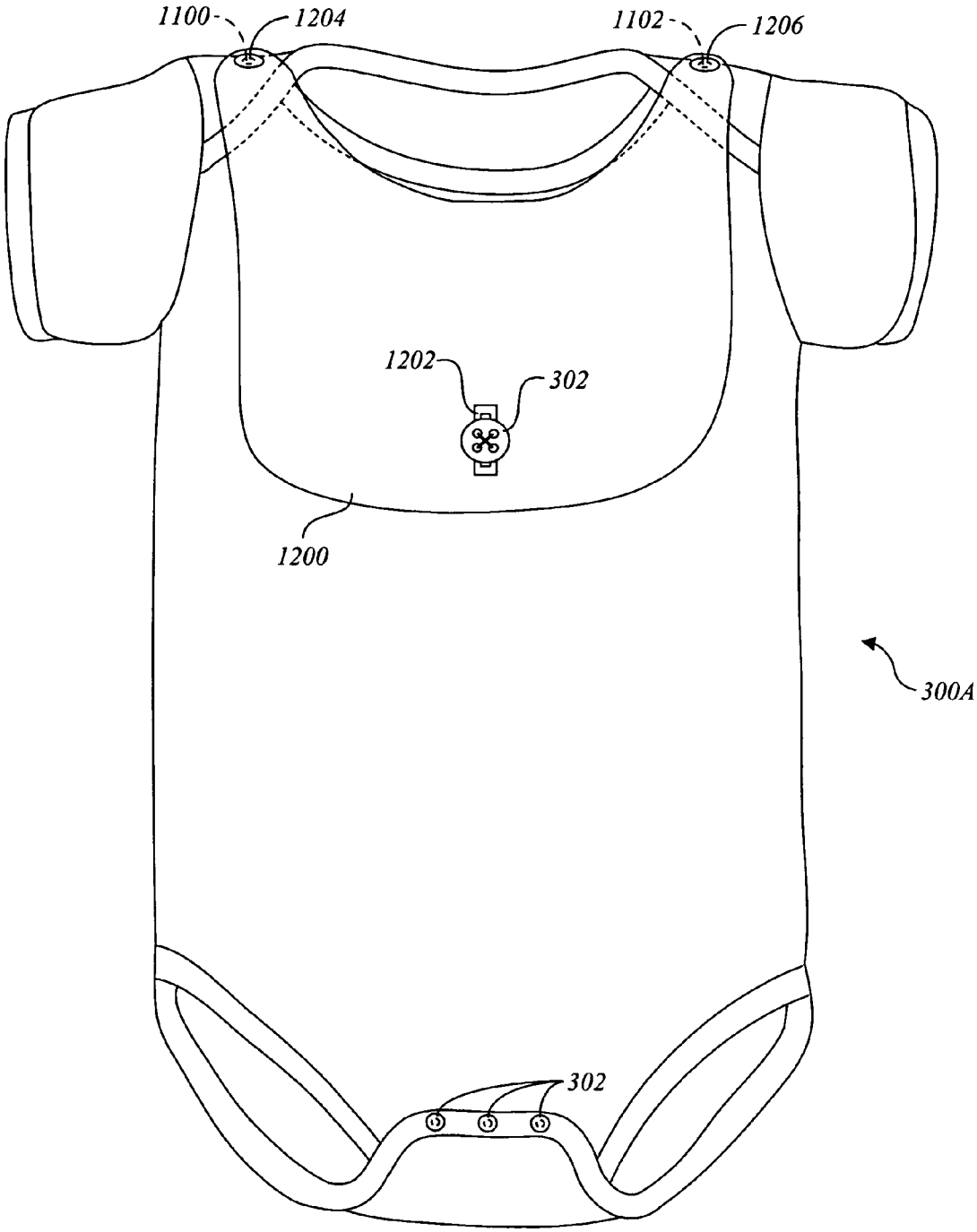
FIG. 11 shows an alternate configuration of the baby garment of FIGS. 3*a* and 3*b* including a pair of snap fasteners disposed on the shoulders of the garment and a mating bib of FIG. 12, wherein the bib is secured to the garment via the pair of snap fasteners on the shoulders and a button in the front.

Another example of this three-point attachment scheme is shown by a baby garment 300A in FIG. 11 and mating bib 1200 shown in FIGS. 11 and 12. In this instance, baby garment 300A includes a pair of snap fastener sockets 1100 and 1102 disposed on its respective shoulders. Similarly, bib 1200 includes snap fasteners 1204 and 1206 having studs extending underneath that are located on the left and right shoulder straps to match the location of the mating snap fastener sockets 1100 and 1102 on baby garment 300A. Meanwhile, the lower portion of bib 1200 is secured to the front of baby garment 300A via the button 302 that is inserted into a mating button hole 1202 formed in bib 1200.

Another feature common to some baby garments is the use of one or more fasteners disposed across one of the shoulders of the garment to enable the size of the neck to be temporarily increased (by unfastening the fasteners) so that the garment can be more easily put on and removed. For example, garments such as shirts and onesies may employ one or two snap fasteners along the left shoulder of the garment, as illustrated by the exemplary baby garments in FIGS. 13*a-c*.

Figure 13A:
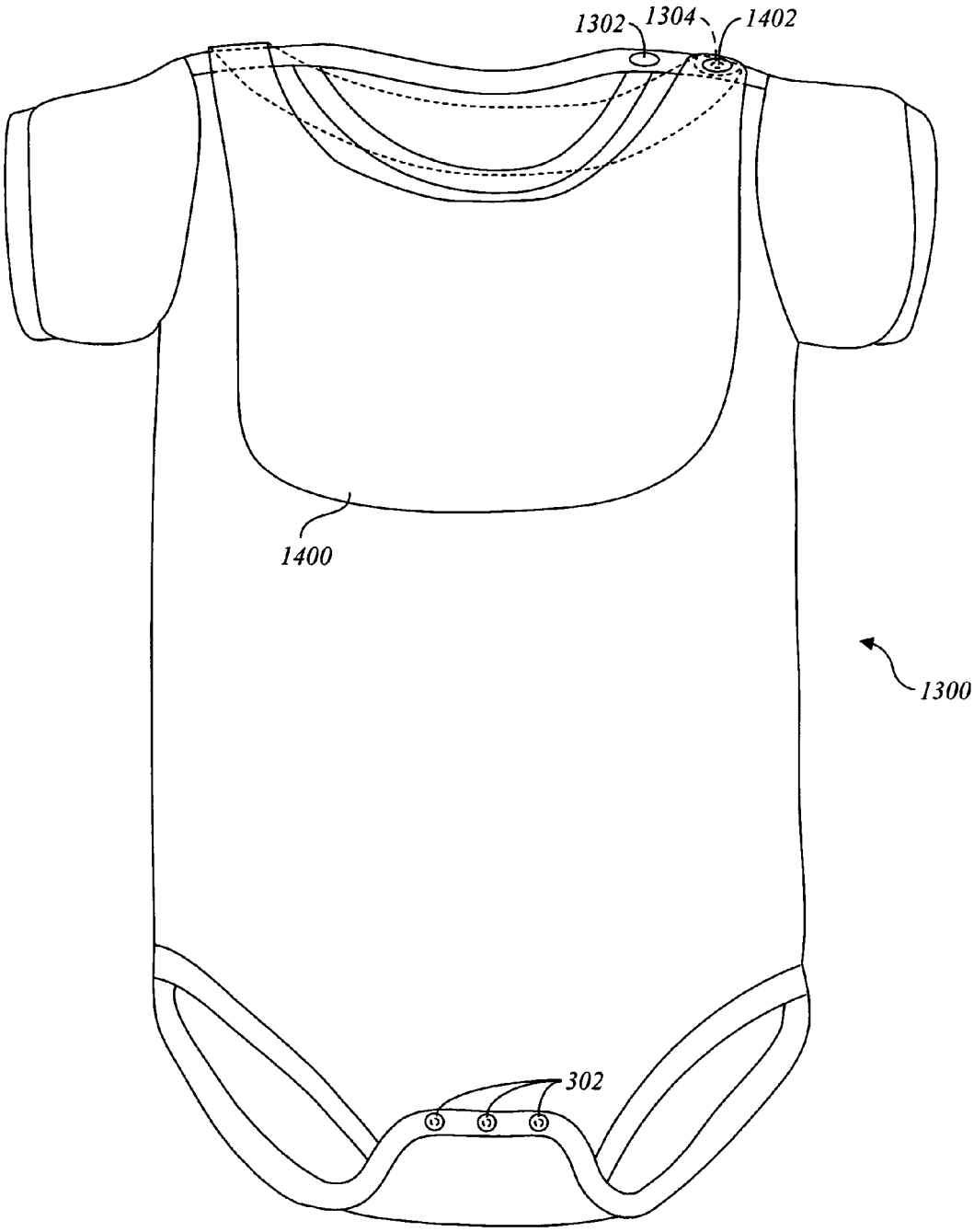
FIGS. 13*a-c* show respective embodiments of a garment and bib configuration in which the bib is attached at one of the garment's shoulders.
Figure 13B:
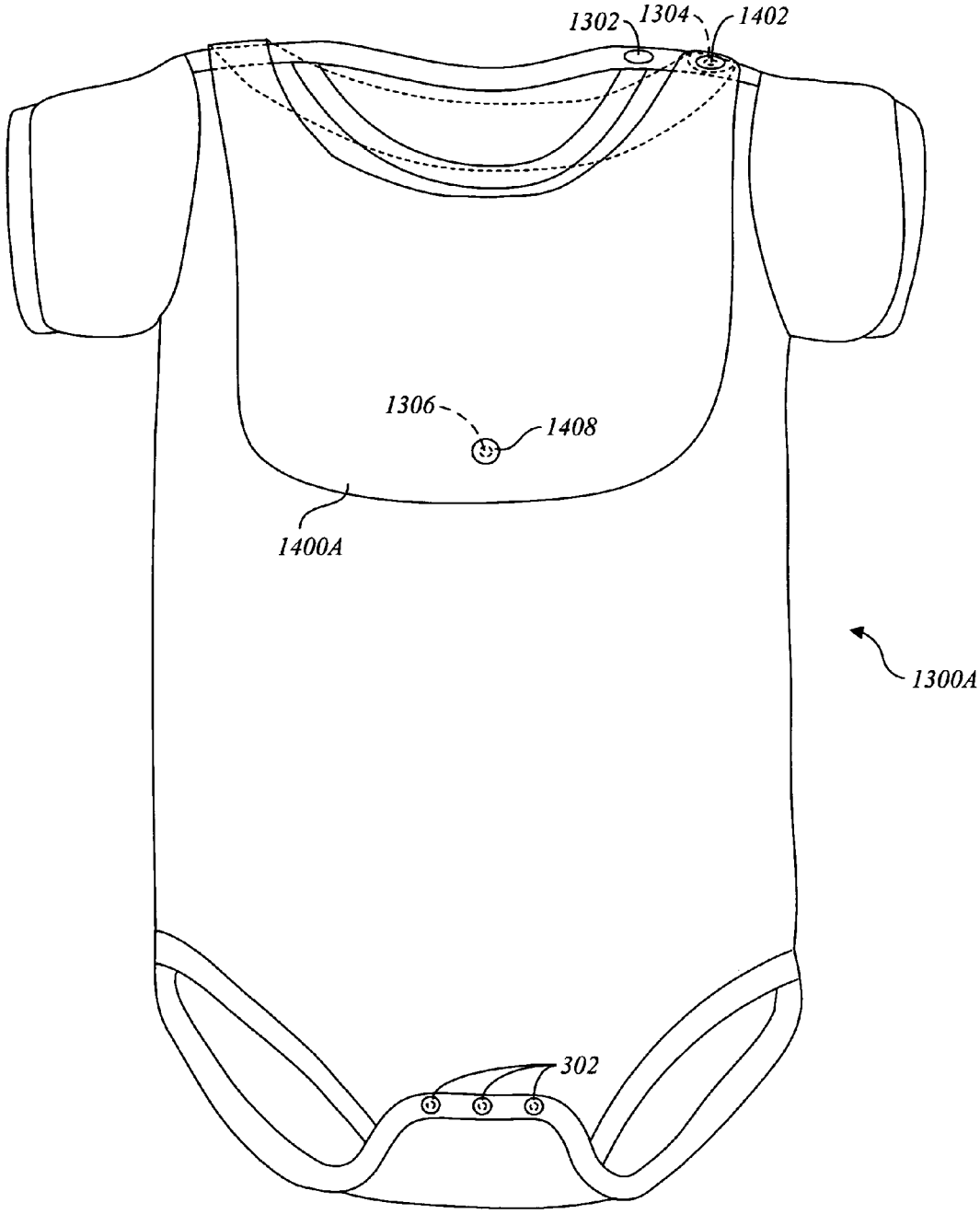
Figure 13C:
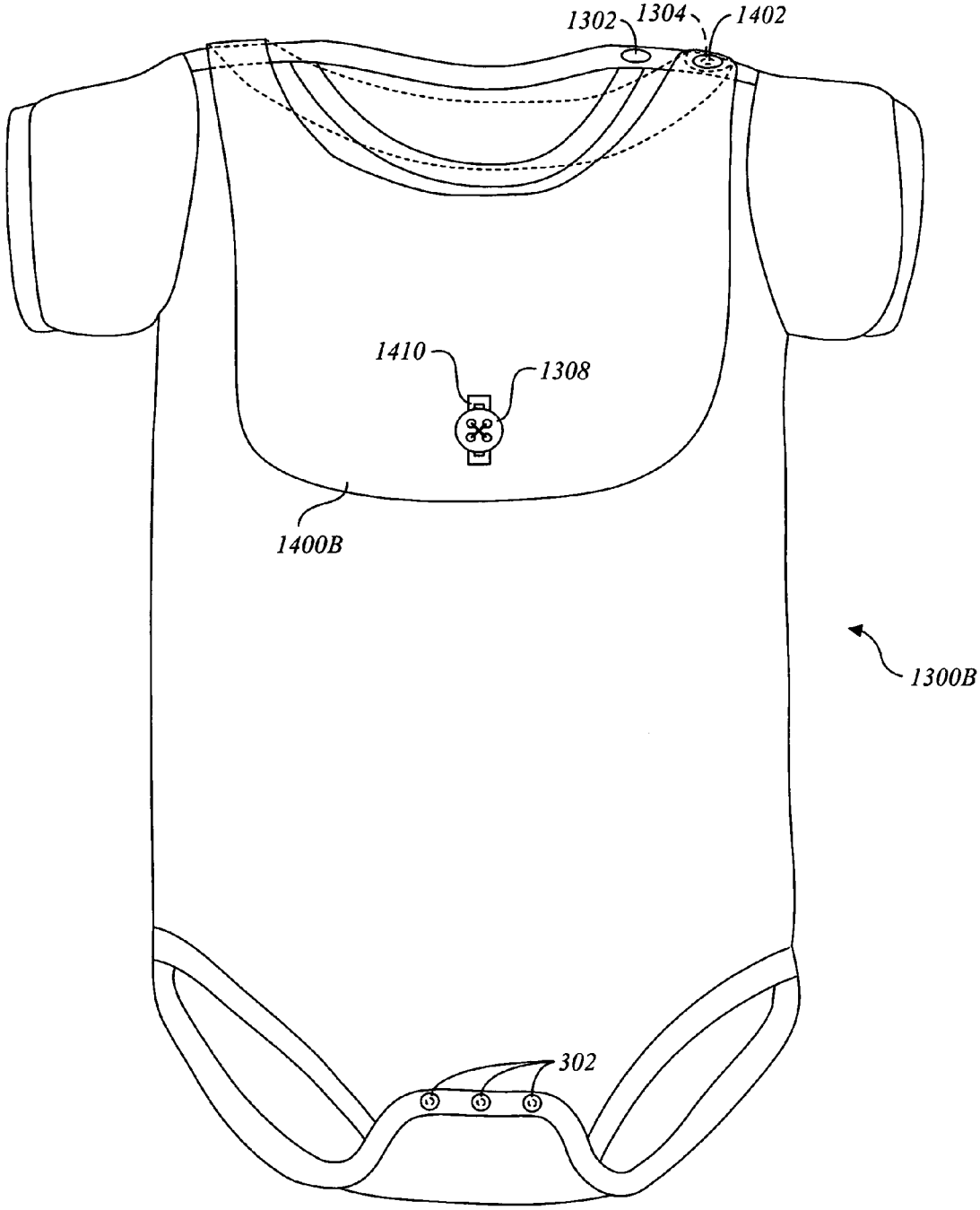

According to another aspect of some embodiments, one of the snap fasteners on a shoulder of a baby garment is used to facilitate attachment of an asymmetrical bib in addition to its conventional fastener function. For example, such a configuration is illustrated in FIG. 13*a*, wherein a bib 1400 is secured to a garment 1300 that includes a snap fastener 1302 and a two-way snap fastener 1304 having a socket on its outer face to facilitate stacked snap fastener.

It is noted that the particular fastener combination shown in the garment and bib sets of FIGS. 9-14 are merely exemplary. In general, any type of mating fastener halves may be used for each attachment point in the three-point attachment schemes. For example, hook and loop fasteners may be used at the shoulders in place of the illustrated snap fasteners. Similarly, buttons may be used at the shoulders. Furthermore, one or both of the shoulders of the garment may include a two-way fastener similar to two-way fastener 1304, wherein a three-part snap fastener is used to secure a bib strap to the garment. As shown in further detail in FIG. 14*a*, bib 1400 includes asymmetrical left and right bib straps 1404 and 1406, which are coupled via a snap fastener 1402 having a stud extending downward from the underlying strap. This stud is then used to engage the socket of two-way fastener 1304, thus securing bib 1400 to the shoulder of garment 1300.

In addition to securing an asymmetrical bib at the shoulder, the garment and bib may provide an additional pair of fasteners to secure the lower front of the bib to the garment in a manner similar to that discussed above. For example, in the configuration illustrated in FIGS. 13*b* and 14*b*, a garment 1300A further includes a first half of a snap fastener 1306 to which a mating fastener half 1408 disposed on the lower front of a bib 1400A is engaged to secure the lower front of bib 1400A to garment 1300A. In another configuration illustrated in FIGS. 13*c* and 14*c* a button 1308 is sewn on the front of a garment 1300B, while a mating button hold 1410 is formed in the lower portion of a bib 1400B, wherein the button is inserted into the button hole to secure the lower portion of bib 1400B to the garment.

Figure 13D:
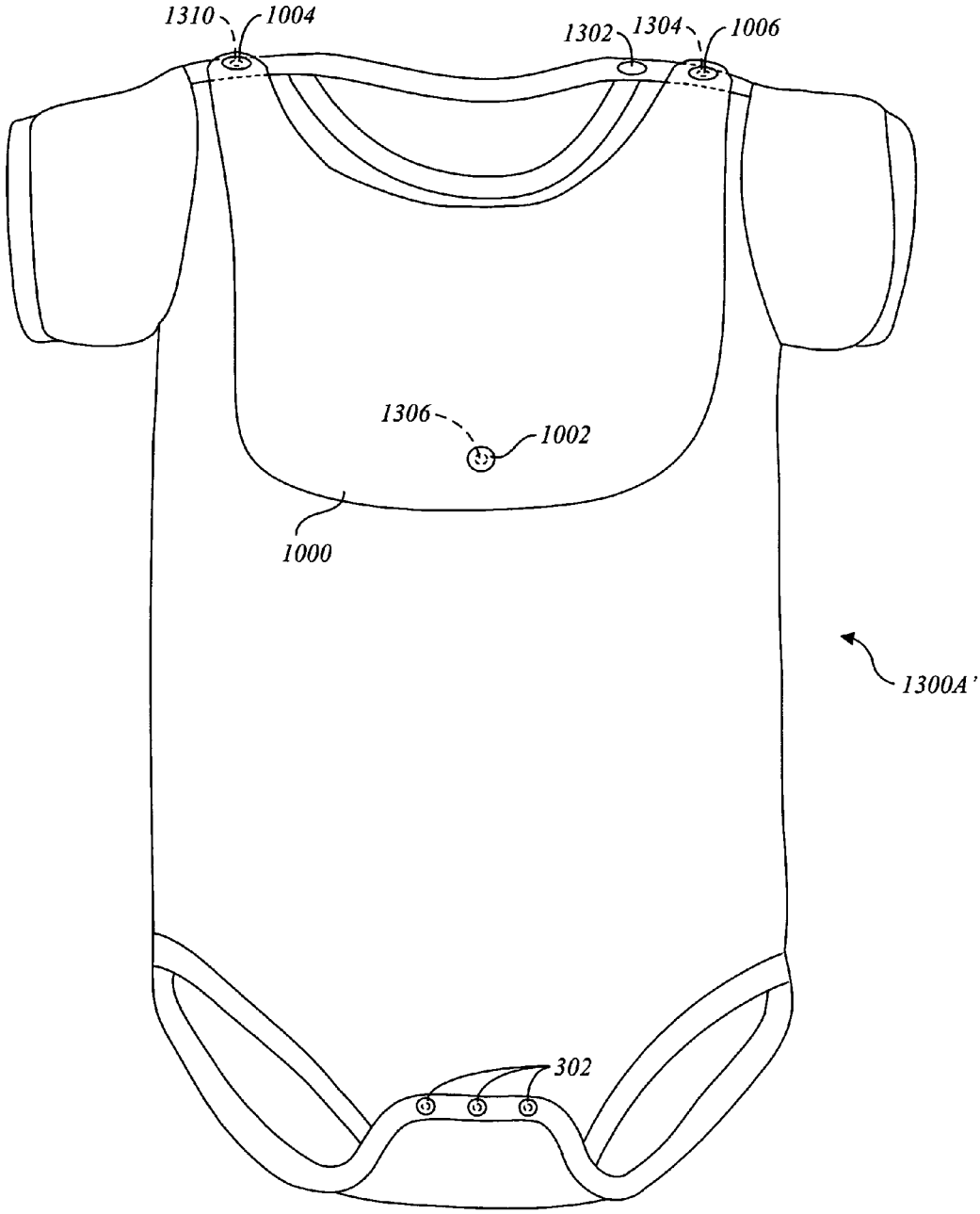
FIG. 13*d* shows an alternative configuration of a three-point attachment scheme wherein one of the fasteners on the baby garment is employed as a stacked fastener.
Figure 14A:
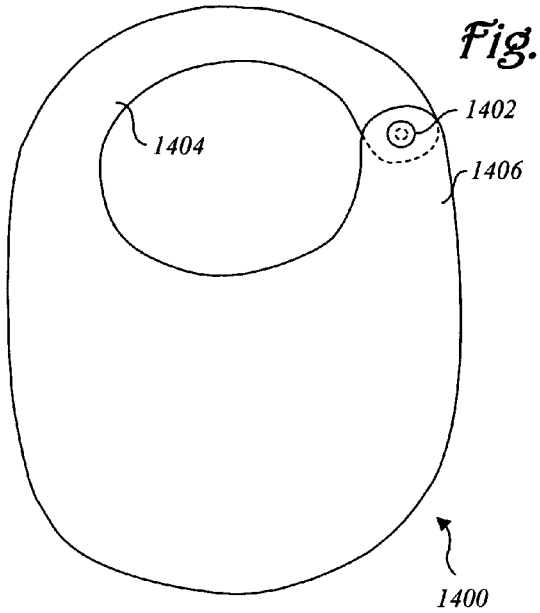
FIGS. 14*a-c* respectively illustrate further details of the bibs shown in FIGS. 13*a-c*.
Figure 14C:
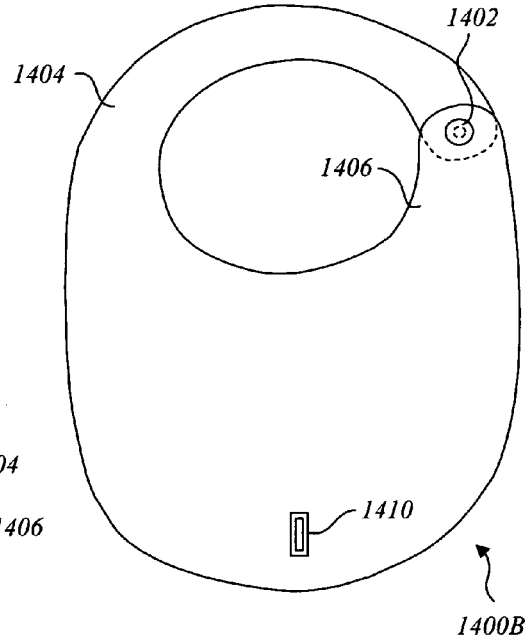
Figure 14B:
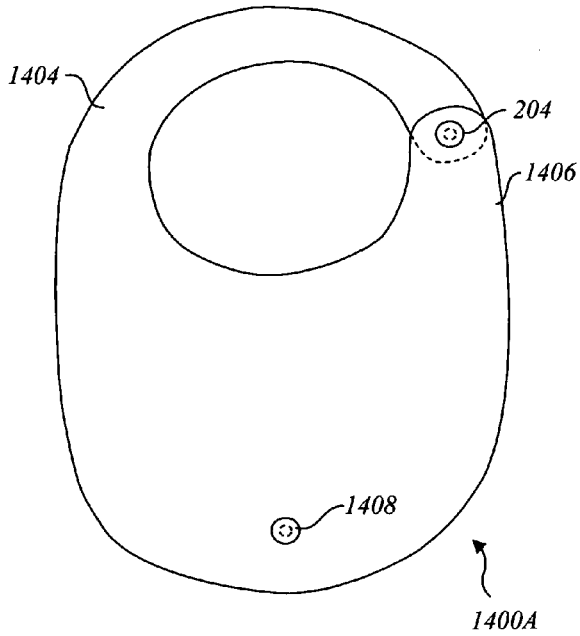
Figure 14D:
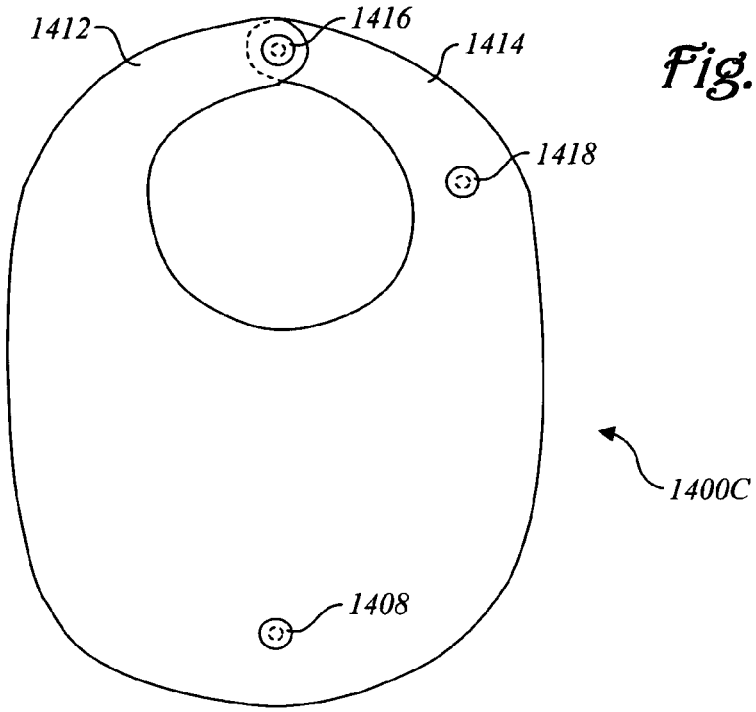
FIGS. 14*d* and 14*e* depict exemplary bibs employing symmetrical neck arms that may be secured to a shoulder and check of a mating garment.
Figure 14E:
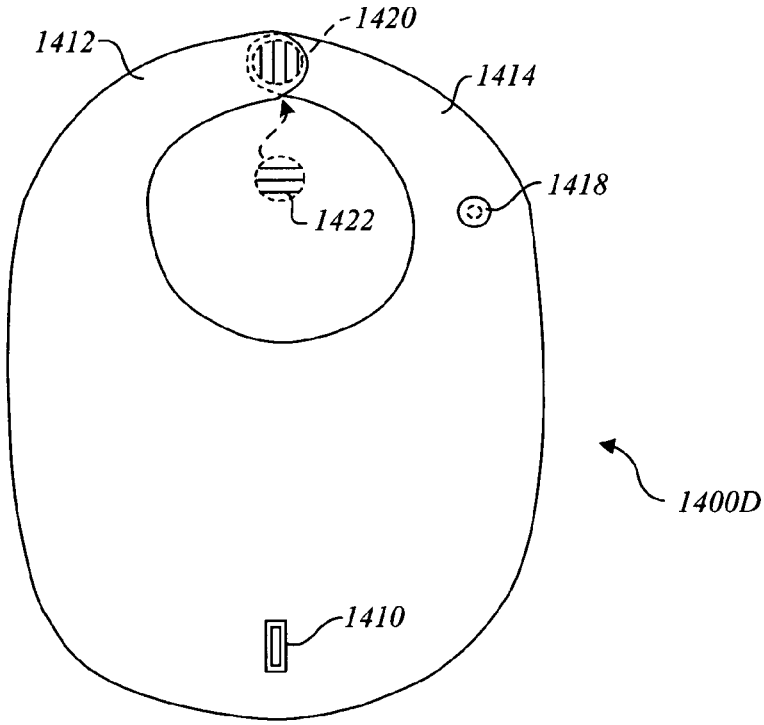

Garments with shoulder snaps may also be augmented to provide a three-point attachment scheme similar to those discussed above. FIG. 13*d* shows an exemplary implementation of such a scheme, wherein a garment 1300A further includes a snap fastener half 1310 disposed on its right shoulder. Thus, garment 1300A provides support for fastening bib 1000 using the three snap fastener halves 1306, 1304, and 1310 to mating fastener halves 1002, 1004, and 1006, respectively, on bib 1000.

Conventional bibs with symmetrical neck straps may also be augmented to facilitate a shoulder point of attachment scheme. Exemplary configurations of a pair of such bibs are respectively represented by a bib 1400C in FIG. 14*d* and a bib 1400D in FIG. 14*e*. Each of bibs 1400C and 1400D include a pair of (substantially) symmetrical neck arms 1412 and 1414, which are secured at there ends using an applicable pair of mating fasteners or other means for coupling the straps, such as a pair of tie strings (not shown). For point of illustration and not limitation, the neck arms of bib 1400C are coupled together using a snap fastener 1416, while bib 1400D employs a mating pair of hoop-and-loop fasteners 1420 and 1422. Each of bibs 1400C and 1400D further include a snap fastener half 1418 disposed on the underside of neck strap 1414 to enable each bib to be secured to the shoulder of an applicable mating garment. In general, the snap fastener half 1418 may be a stud or a socket.

As before, a bib that is attached at the shoulder of a garment may also (optionally) provide another point of attachment proximate to the check area of the garment through use of an appropriate fastener half disposed toward the lower portion of the bib. Representative fastener halves for facilitating this function include a snap fastener half 1408 for bib 1400C and a button hole 1410 for bib 1400D.

Garments with shoulder snaps may also be augmented to provide a three-point attachment scheme similar to those discussed above. FIG. 13*d* shows an exemplary implementation of such a scheme, wherein a garment 1300A further includes a snap fastener half 1310 disposed on its right shoulder. Thus, garment 1300A provides support for fastening bib 1000 using the three snap fastener halves 1306, 1304, and 1310 to mating fastener halves 1002, 1004, and 1006, respectively, on bib 1000.

In addition to the two-way snap fasteners using a pair of opposing sockets described above, two-way snap fastener members having other configuration may also be used. For example, a two-way snap fastener member including a pair of opposing studs may be used. Optionally, a two-way snap fastener member including a socket on one side and a stud on the other side may be employed.

The embodiments described above provide an effective means for securing a bib to a baby garment or the like in a manner that keeps the front of the bib substantially flat with the front of the garment, while preventing rotation of the bib around the neck. Accordingly, there is a substantially reduced likelihood that the bib will end up covering a baby's face. Furthermore, since the bib remains secured to the garment at a desired orientation, there is no need to have to reposition the bib when it is worn. In addition, the bib may be easily and quickly attached to the mating garment, allowing a soiled bib to be easily replaced. Moreover, since the bib stays in the proper orientation, it serves its purpose better, thus reducing the need to change the underlying garment.

Another advantage of the schemes disclosed herein relates to the design of the garments. In general, the additional fastener members may be added in a manner that provides minimal alteration to a conventional garment. For example, in embodiments using stacked snap fastener assemblies, the lower fastener pair in the stack will typically perform the same function as would be performed by a conventional stacked fastener. Furthermore, garments employing a button may used the button for a secondary purpose, such as for the nose of an animal face printed or otherwise formed on the front of the garment.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the drawings. Rather, the scope of the invention is to be determined entirely by the following claims, which are to be construed in accordance with established doctrines of claim interpretation.

What is claimed is:

1. A set of clothing, comprising:

a garment, including a first fastener half disposed proximate to a chest area of the garment and a first shoulder snap fastener component disposed on a first shoulder of the garment; and a mating bib including, a main body having a second fastener half configured to mate with the first fastener half and disposed toward a lower portion of the main body to secure the lower portion of the main body to the chest area of the garment when the first and second fasteners halves are mated; and an asymmetrical pair of straps coupled to the main body and having end portions that are coupled to one another using a pair of bib strap snap fastener components including a lower two-way snap fastener configured to mate with the first shoulder snap fastener component, the bib strap snap fastener components and the first shoulder snap fastener component comprising a three-piece stacked snap fastener assembly.

2. The set of clothing of claim 1, wherein the first and second fastener halves comprise mating snap fasteners.

3. The set of clothing of claim 1, wherein the garment includes a plurality of snap fasteners arranged in a line to couple a left-hand front portion of the garment to a right hand front portion of the garment, one of said plurality of snap fasteners being the first fastener half comprising a stackable snap fastener including a socket disposed on a face side of the garment into which a mating stud disposed on the underside of the bib and comprising the second fastener half is inserted to secure the lower portion of the bib to the garment.

4. The set of clothing of claim 1, wherein the first and second fastener halves respectively comprise a button attached to the chest area of a garment that is inserted into a mating button hole on the main body of the bib.

5. A set of clothing, comprising:

a garment, configured to be worn by a baby, toddler, or small child, including, a main body including an open neck and having a first fastener half disposed proximate to a chest area of the main body;

a split shoulder portion coupled to the open neck including at least one snap fastener pair used to close the split shoulder portion, wherein an upper snap fastener half of the at least one snap fastener pair comprises a first stackable snap fastener half including a snap fastener socket disposed on a face of an overlapping portion of the split shoulder portion; and a mating bib including, a main body having a second fastener half configured to mate with the first fastener half and disposed toward a lower portion of the main body to secure the lower portion of the main body to the chest area of the garment when the first and second fasteners halves are mated; and an asymmetrical pair of straps coupled to the main body and having end portions that are coupled to one another using a pair of fastening means, one of said asymmetrical pair of straps having a stud extending outward from an underside thereof configured to mate with the socket of the first stackable snap fastener half to secure the bib to the shoulder of the garment, wherein the stud and the at least one snap fastener pair form a three-piece stacked snap fastener assembly when mated.

6. The set of clothing of claim 5, wherein the first and second fastener halves comprise a button and buttonhole.

7. The set of clothing of claim 5, wherein the pair of fastening means to couple the end portions of the asymmetrical pair of straps to one another comprise a pair of snap fastener halves.

8. The set of clothing of claim 7, wherein a lower snap fastener half of the pair of snap fastener halves comprises a second stackable snap fastener half including the stud extending outward from the underside of said one of the asymmetrical pair of straps.

9. The set of clothing of claim 5, wherein the garment comprises a onesie.

10. A garment, configured to be worn by a baby, toddler, or small child, comprising:

a main body including an open neck and having a button disposed proximate to a chest area of the main body;

a split shoulder portion coupled to the open neck including at least one snap fastener pair used to close the split shoulder portion, wherein an upper snap fastener half of the at least one snap fastener pair comprises a stackable snap fastener half including a snap fastener socket disposed on a face of an overlapping portion of the split shoulder portion, wherein the button and the upper snap fastener half are located and configured to respectively mate with a button hole and snap fastener stud of a bib configured to mate with the garment to form a set of clothing.

11. The garment of claim 10, wherein the garment comprises a onesie.

12. The garment of claim 10, wherein the button is employed as part of a design on the front of the garment.

13. The garment of claim 12, wherein the design is of an animal, and the button is employed as a feature on the animal.

14. The garment of claim 13, wherein the feature comprises a nose of the animal.

15. The garment of claim 12, wherein the design comprises one of an appliqué or silk-screened design.

16. A bib, configured to mate with a garment having a button proximate to a chest area thereof and a snap fastener socket on a first shoulder thereof, the bib comprising:

a main body having a button hole disposed toward a lower portion of the main body to secure the lower portion of the main body to the chest area of the garment when the button is mated in the buttonhole; and an asymmetrical pair of straps coupled to the main body and having end portions that are coupled to one another using a pair of fastening means, one of said asymmetrical pair of straps having a stud extending outward from an underside thereof configured to mate with the snap fastener socket on the first shoulder of the garment.

17. The bib of claim 16, wherein the pair of fastening means to couple the end portions of the asymmetrical pair of straps to one another comprise a pair of snap fastener halves.

18. The bib of claim 17, wherein pair of snap fastener halves include an upper snap fastener half and an upper snap fastener half, the lower snap fastener half comprising a stackable snap fastener half including a socket face configured to receive a stud of the top snap fastener half and including the stud extending outward from the underside of said one of the asymmetrical pair of straps such that when the upper and lower snap fastener halves of the bib strap end portions and the snap fastener socket on the first shoulder of the garment are mated a three-piece stacked snap fastener assembly is formed.

* * * * *